US008577234B2

(12) United States Patent
Kato

(10) Patent No.: US 8,577,234 B2
(45) Date of Patent: Nov. 5, 2013

(54) IMAGE FORMING APPARATUS WITH MEDIUM TRANSPORT CONTROL

(75) Inventor: Koji Kato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 565 days.

(21) Appl. No.: 12/603,386

(22) Filed: Oct. 21, 2009

(65) Prior Publication Data

US 2010/0104301 A1 Apr. 29, 2010

(30) Foreign Application Priority Data

Oct. 24, 2008 (JP) ..... 2008-274255

(51) Int. Cl.
*G03G 15/00* (2006.01)

(52) U.S. Cl.
USPC ..... 399/44

(58) Field of Classification Search
USPC ..... 399/44
See application file for complete search history.

(56) References Cited

U.S. PATENT DOCUMENTS

| | | | | |
|---|---|---|---|---|
| 5,300,981 | A * | 4/1994 | Shioya | 399/33 |
| 2004/0091281 | A1* | 5/2004 | Kimizuka | 399/92 |
| 2009/0080926 | A1* | 3/2009 | Kurokawa | 399/69 |

FOREIGN PATENT DOCUMENTS

| | | | |
|---|---|---|---|
| JP | 07-160066 | A | 6/1995 |
| JP | 2002-179282 | A | 6/2002 |
| JP | 2003-122061 | A | 4/2003 |
| JP | 2003-215869 | A | 7/2003 |
| JP | 2004-333930 | A | 11/2004 |
| JP | 2005-189372 | A | 7/2005 |
| JP | 2008-111888 | A | 5/2008 |

* cited by examiner

*Primary Examiner* — David Gray
*Assistant Examiner* — Andrew Do
(74) *Attorney, Agent, or Firm* — Marvin A. Motsenbocker; Mots Law, PLLC

(57) ABSTRACT

An image forming apparatus includes: a medium transport path which a medium is transported through; an image forming unit configured to form a developer image on the medium transported through the medium transport path; a fusing unit configured to fix the developer image formed on the medium to the medium; a temperature detecting unit configured to detect temperature in the image forming apparatus; and a controller operable to temporarily stop the transport of the medium in the medium transport path when the temperature detected by the temperature detecting unit is equal to or higher than a predetermined temperature.

9 Claims, 13 Drawing Sheets

IMAGE FORMING APPARATUS WITH MEDIUM TRANSPORT CONTROL

CROSS REFERENCE TO RELATED APPLICATIONS

This application claims priority based on 35 USC 119 from prior Japanese Patent Application No. P2008-274255 filed on Oct. 24, 2008, entitled "Image Forming Apparatus", the entire contents of which are incorporated herein by reference.

BACKGROUND OF THE INVENTION

1. Field of the Invention

The present invention relates to an image forming apparatus such as an electrophotographic printer.

2. Description of Related Art

Conventionally, a typical image forming apparatus such as an electrophotographic printer has units to process electrophotography. In other words, the image forming apparatus includes an image forming unit configured to perform a charging step for evenly charging a photoconductive insulating layer of a photosensitive drum, an exposing step for forming an electrostatic latent image on the photosensitive drum, a developing step for developing an image by applying developer (toner) from a development roller on the photosensitive drum, and a transferring step for transferring the developed image onto a sheet; and a fusing unit configured to perform a fusing step for fixing the developed image on the sheet by heating and pressing.

The image forming apparatus can perform one-side printing and double-sided printing on a sheet by conveying the sheet through the units. Japanese Patent Application Laid-Open No. 2002-179282 discloses an image forming apparatus capable of double-sided printing in which a sheet passes through an image forming unit and a fusing unit so that an image is printed on a first side of the sheet, the sheet is turned over by a reverse mechanism, and re-fed to the image forming unit and the fusing unit so that an image is printed on the second side of the sheet.

SUMMARY OF THE INVENTION

However, when the temperature in the image forming apparatus increases, toner tends to cake or become lumps and this may deteriorate the image quality.

An aspect of the present invention is an image forming apparatus including: a medium transport path through which a medium is transported; an image forming unit configured to form a developer image on the medium transported through the medium transport path; a fusing unit configured to fix to the medium the developer image formed on the medium; a temperature detecting unit configured to detect the temperature in the image forming apparatus; and a controller operable to temporarily stop the transportation of the medium in the medium transport path when the temperature detected by the temperature detecting unit is equal to or higher than a predetermined temperature.

Another aspect of the present invention is an image forming apparatus including: an image forming unit configured to form a developer image on the medium including; a fusing unit configured to fix to the medium the developer image formed on the medium; a re-feeding path configured to re-feed the medium that had passed though the image forming unit back to the image forming unit, the re-feeding path having a reverse section configured to turn over the medium; and an opening formed in the vicinity of the reverse section and communicating from outside the image forming apparatus to inside the image forming apparatus.

According to the aspects of the present invention, the deterioration of the image quality in the image forming apparatus can be reduced.

DETAILED DESCRIPTION OF EMBODIMENTS

Figure 1:
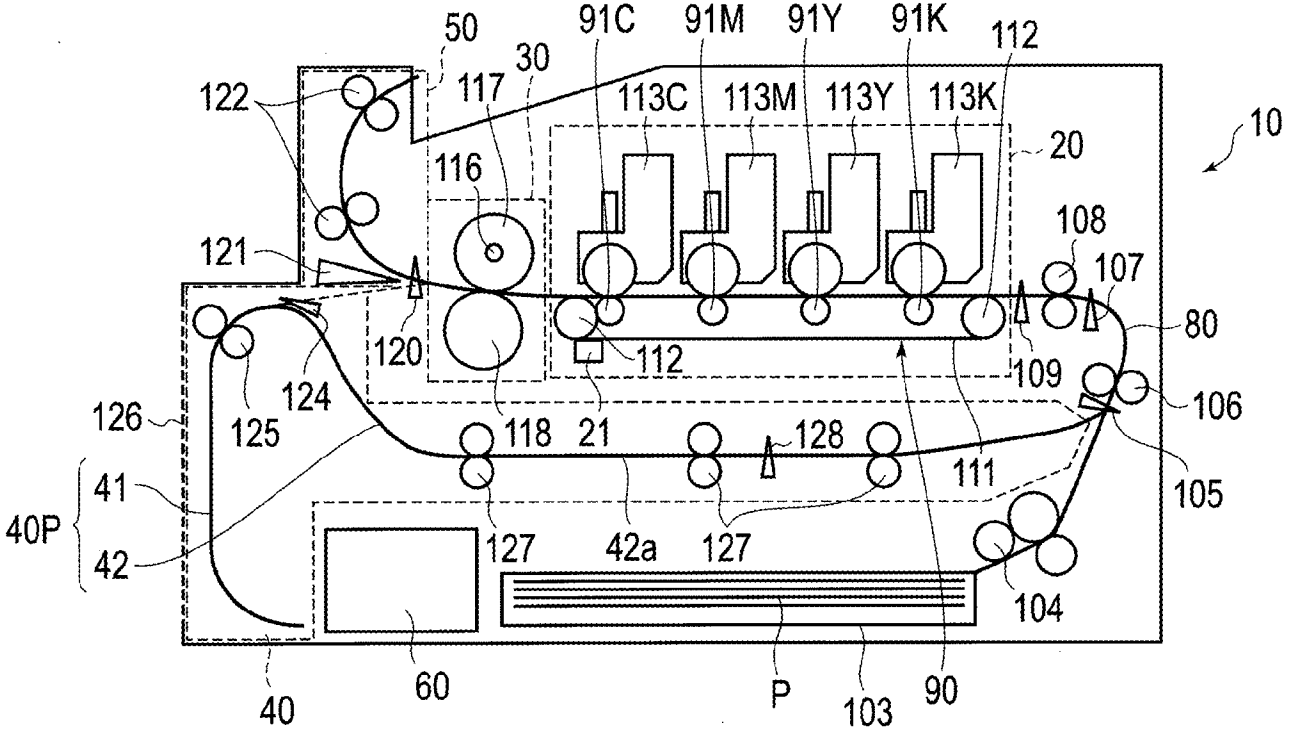
FIG. 1 is a sectional diagram of a printer according to a first embodiment.

Descriptions are provided hereinbelow for embodiments based on the drawings. In the respective drawings referenced herein, the same constituents are designated by the same reference numerals and duplicate explanation concerning the same constituents is basically omitted. All of the drawings are provided to illustrate the respective examples only.

First Embodiment

FIG. 1 is a sectional view of electrophotographic printer 10 according to a first embodiment. Printer 10 accommodates sheets P serving as printing media in a stacked manner. That is, printer 10 has sheet cassette 103 configured to accommodate sheets P in a stacked manner. Printer 10 has therein a medium transport path including main medium transport path 80 extending from sheet cassette 103 sequentially through image forming unit 20, fusing unit 30 and discharge unit 50 to a sheet discharge tray and medium re-feeding path 40P connecting from downstream of fusing unit 30 to upstream of image forming unit 20 and configured to re-feed sheet P to image forming unit 20. Printer 10 has a sheet-feeding roller 104. Sheet-feeding roller 104 is configured to feed sheet P to the medium transport path from sheet cassette 103. Sheet P fed from the sheet cassette 103 travels along the medium transport path. Printer 10 has first inlet sensor 105 serving as a first sensor. First inlet sensor 105 is a transmission-type photointerrupter that detects sheet P, that is, detects the front end and a rear end of transported sheet P. Printer 10 has first resist roller 106. First resist roller 106 is configured to transport sheet P while correcting the orientation of sheet P before entering the printing process in image forming unit 20. Printer 10 has second inlet sensor 107 serving as a second sensor. Second inlet sensor 107 is a transmission-type photointerrupter that detects sheet P, that is, detects the front end and rear end of transported sheet P. Printer 10 has second resist roller 108. Second resist roller 108 is configured to transport sheet P while correcting the orientation of sheet P before entering the printing process in image forming unit 20. Printer 10 has write sensor 109. Write sensor 109 is a transmission-type photointerrupter that detects sheet P, that is, the front end of transported sheet P to control image writing timing in image forming unit 20 that is downstream of write sensor 109. Image forming unit 20 has ID devices (image drum devices or image forming devices) 113K, 113Y, 113M, 113C. The respective ID device 113K, 113Y, 113M, 113C (hereinafter, referred to as ID device 113) have rotating members such as a photosensitive drum and a development roller. Transfer device 90 has transfer rollers 91K, 91Y, 91M, 91C, sheet transport belt 111, and a belt roller 112 for driving sheet transport belt 111. Sheet transport belt 111 is configured to transport sheet P along a line of image forming devices 113. Transfer device 90 is an electrophotographic print mechanism configured to transfer toner images of K (black), Y (yellow), M (magenta) and C (cyan) onto sheet P. Image forming unit 20 has temperature sensor 21 disposed in the vicinity of sheet transport belt 111. Temperature sensor 21 measures ambient temperature around ID device 113.

Fusing unit 30 or fusing device functions as a fixing unit or fixing device configured to fix the toner image onto sheet P. Fusing unit 30 heats sheet P that has a transferred toner image thereon to fuse the toner image so as to fix the toner image onto sheet P. Fusing unit 30 includes fuser roller 117 having halogen lamp 116 and backup roller 118. Fuser roller 117 is heated up to fusing temperature by electric power applied to halogen lamp 116.

Sheet P, passed through fusing unit 30, is transported to discharge unit 50. Discharge unit 50 has discharge sensor 120. Discharge sensor 120 is a transmission-type photointerrupter configured to detect the front end and rear end of sheet P which is passed thought fusing unit 30. Discharge unit 50 has separator 121 which is a component configured to switch between a discharge route (a downstream end portion of main medium transport path 80) and a double-side print route (medium re-feeding path 40P) of transport sheet P. In discharge unit 50, discharge roller 122 discharges sheet P out of the printer.

When separator 121 is set to double-side print route (medium re-feeding path 40P), sheet P is transported to medium re-feeding path 40P in re-feed unit 40. Re-feed unit 40 has re-feed unit inlet sensor 124. Re-feed unit inlet sensor 124 is a transmission-type photointerrupter that detects the front end and rear end of transported sheet P. Re-feed unit 40 has a reverse roller 125. Reverse roller 125 inverts sheet P, that is, reverses the transport direction of sheet P such that the previous trailing edge becomes the leading edge and side one now faces down rather than up. Re-feed unit 40 has a reverse section which is a turn-around or switchback section where sheet P is inverted by reverse roller 125. The body of printer 10 has slits 126 which open at reverse section 41 and ventilate reverse section 41, that is, exchanges air outside printer 10 for air inside printer 10.

Figure 2:
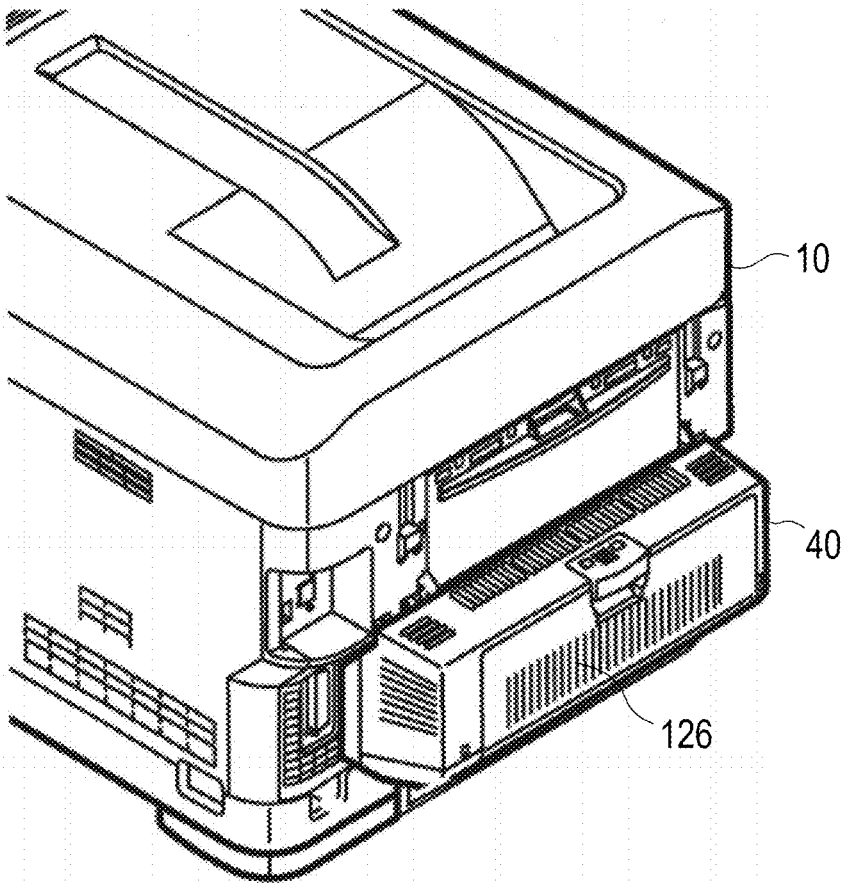
FIG. 2 is a perspective diagram of the printer.

FIG. 2 is a partial external perspective diagram of printer 10, showing an external view of re-feed unit 40 having slits 126. Referring back to FIG. 1, re-feed unit 40 includes medium re-feeding path 40P having reverse section 41 and re-feeding main path 42. Reverse section 41 is a turn-around or switchback section, that is, a dead-end space for reversing and turning over sheet P. After sheet P is transported to reverse section 41 by reverse rotation of reverse roller 125, sheet P is transported from reverse section 41 to downstream re-feeding main path 42 by positive rotation of reverse roller 125. During a period when reverse roller 125 stops after reverse rotation of reverse roller 125 and before positive rotation of reverse roller 125, one end of sheet P is held by reverse roller 125 and the other end of sheet P is not held. During the period, sheet P has a curved shape as shown in FIG. 1 because sheet P has been deformed to have curl as it was transported. Note that even though reverse section 41 is formed as a space in the embodiment, reverse section 41 does not have to be formed as a space and can be made as a curved path. Further, as described above, outer frame 123 of re-feed unit 40 has slits 126 in the vicinity of reverse section 41. With this configuration, sheet P transported to reverse section 41 is cooled by air outside printer 10 which enters into reverse section 41 through slits 126. Note that, in the first embodiment, when temperature sensor 21 detects high temperature, transportation of sheet P is stopped and reverse section 41 is used as a space where sheet P is kept on hold.

Further, re-feed unit 40 has transport rollers 127 along re-feeding main path 42. Re-feeding main path 42 includes flat section 42*a* extending in straight-line manner which is located downstream of reverse section 41 to bring turned-over sheet P back to image forming unit 20. Re-feed unit 40 has re-feed unit front sensor 128. Re-feed unit front sensor 128 is a transmission-type photointerrupter that detects the front end and rear end of transported sheet P. Further, printer 10 has controller 60 that controls printing operation of printer 10.

Figure 3:
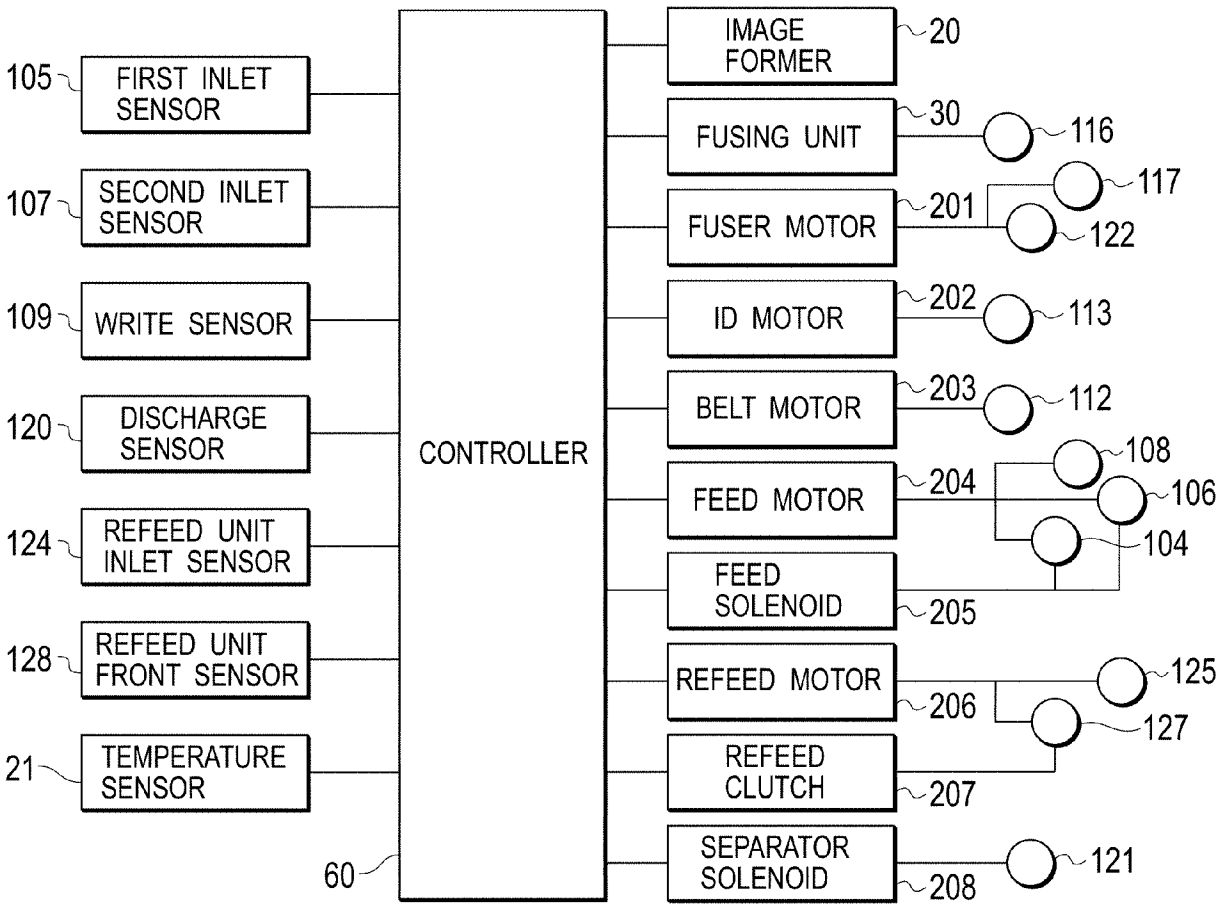
FIG. 3 is a block diagram showing connections in the printer.

Next, connection relationships between controller 60 and other components will be described. FIG. 3 is a connection block diagram of printer 10. Controller 60 receives signals from first inlet sensor 105, second inlet sensor 107, write sensor 109, discharge sensor 120, re-feed unit inlet sensor 124 and re-feed unit front sensor 128. Further, controller 60 receives signals from temperature sensor 21 to measure ambient temperature around ID device 113. Controller 60 is connected to image forming unit 20 to control image forming unit 20 to form a toner image and transfer the toner image onto sheet P. Controller 60 is connected to fusing unit 30 to control the heating of halogen lamp 116 in fusing unit 30. Controller 60 drives fuser motor 201. Fuser motor 201 rotates discharge roller 122 and fuser roller 117. Controller 60 drives ID motor 202. ID motor 202 rotates the rotating mechanism of ID device 113. Controller 60 drives belt motor 203. Belt motor 203 rotates belt roller 112.

Further, controller 60 drives feed motor 204. Feed motor 204 rotates sheet-feeding roller 104, first resist roller 106 and second resist roller 108. Controller 60 drives feed solenoid 205. When feed motor 204 is ON and feed solenoid 205 is ON, sheet-feeding roller 104 and second resist roller 108 rotate. When feed motor 204 is ON and feed solenoid 205 is OFF, first resist roller 106 and second resist roller 108 rotate.

Further, controller 60 drives re-feed motor 206. Re-feed motor 206 rotates reverse roller 125 and transport rollers 127. The rotation direction of re-feed motor 206 can be changed. When re-feed motor 206 rotates in reverse rotation direction, reverse roller 125 rotates in a direction so that sheet P is pulled into reverse section 41. When re-feed motor 206 rotates in positive rotation direction, reverse roller 125 rotates in a direction so that sheet P is sent to re-feeding main path 42. Further, re-feed motor 206 rotates transport rollers 127 which are connected to re-feed motor 206 via a planetary gear. Controller 60 drives re-feed clutch 207. When re-feed motor 206 is ON and re-feed clutch 207 is ON, transport rollers 127 rotates. When re-feed motor 206 is ON and re-feed clutch 207 is OFF, transport rollers 127 do not rotate.

Further, controller 60 drives separator solenoid 208. When separator solenoid 208 is ON, separator 121 leads sheet P that has passed though fusing unit 30 to the double side print route (re-feed path 40P) in re-feed unit 40. When separator solenoid 208 is OFF, separator 121 leads sheet P that has passed though fusing unit 30 to discharge unit 50 (downstream of medium transport main path 80).

Figure 4:
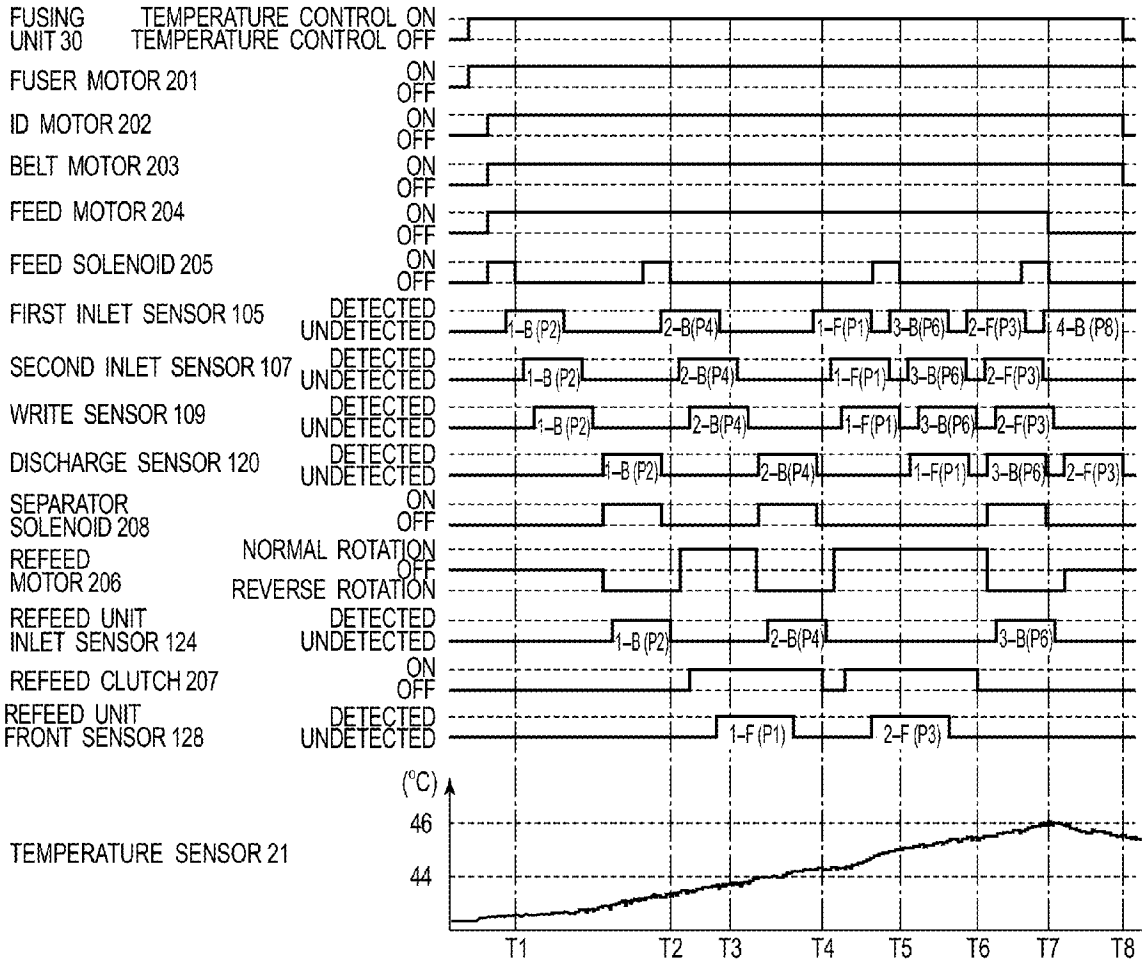
FIG. 4 is a part of a time chart of an operation of the printer according to the first embodiment, showing times T1 to T8.
Figure 5:
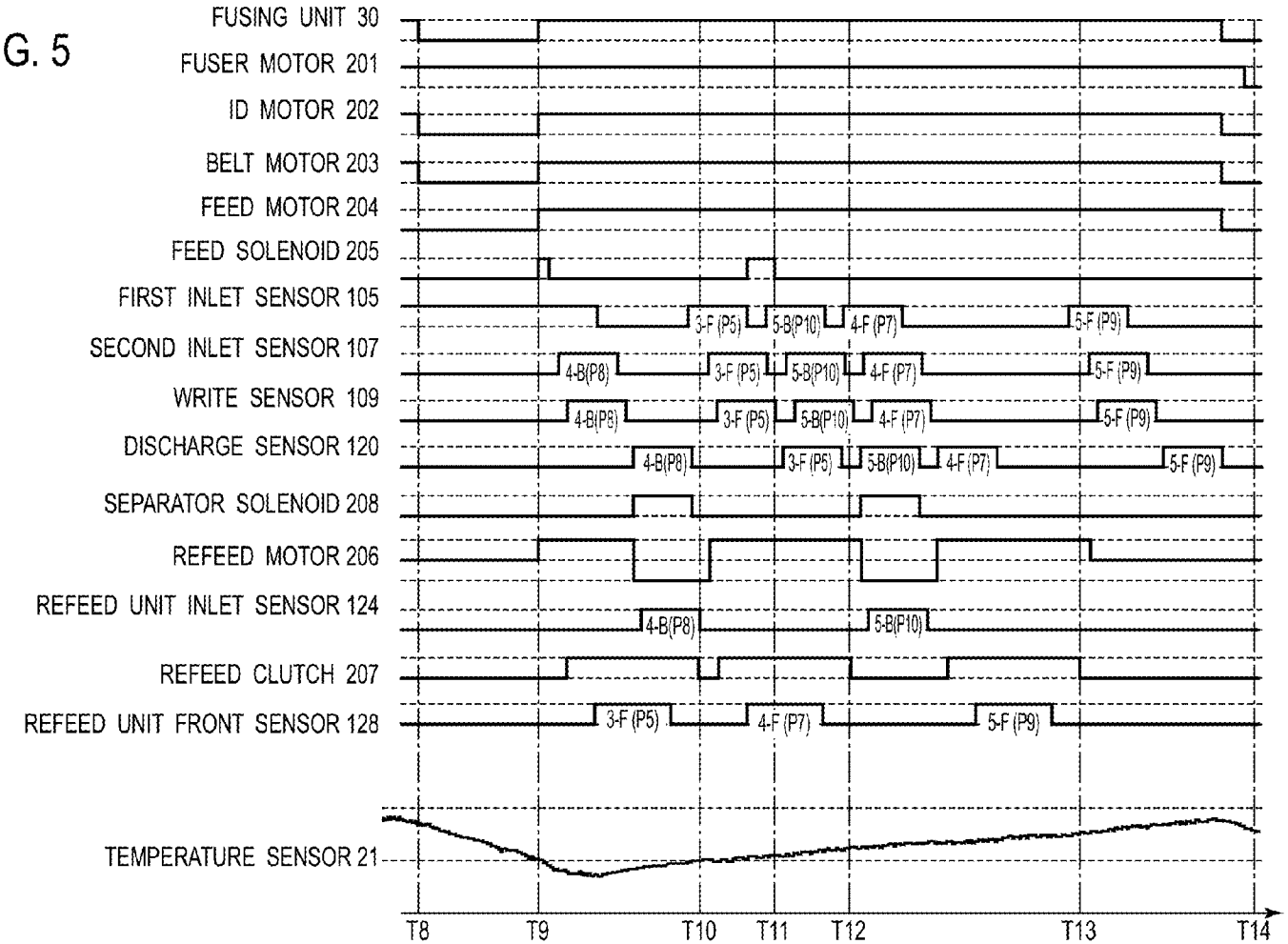
FIG. 5 is a part of the time chart of the operation of the printer according to the first embodiment, showing Times T9 to T14.

Next, operations of printer 10 according to the first embodiment will be described with reference to FIG. 4 and FIG. 5. FIGS. 4 and 5 show a time chart of operations of printer 10 according to the first embodiment. The operations will be described following the time series shown in FIGS. 4 and 5. Note that FIGS. 6 to 9 are explanatory diagrams showing how sheet P is transported in the respective time T1 to T14 in the time chart shown in FIGS. 4 and 5.

Figure 6:
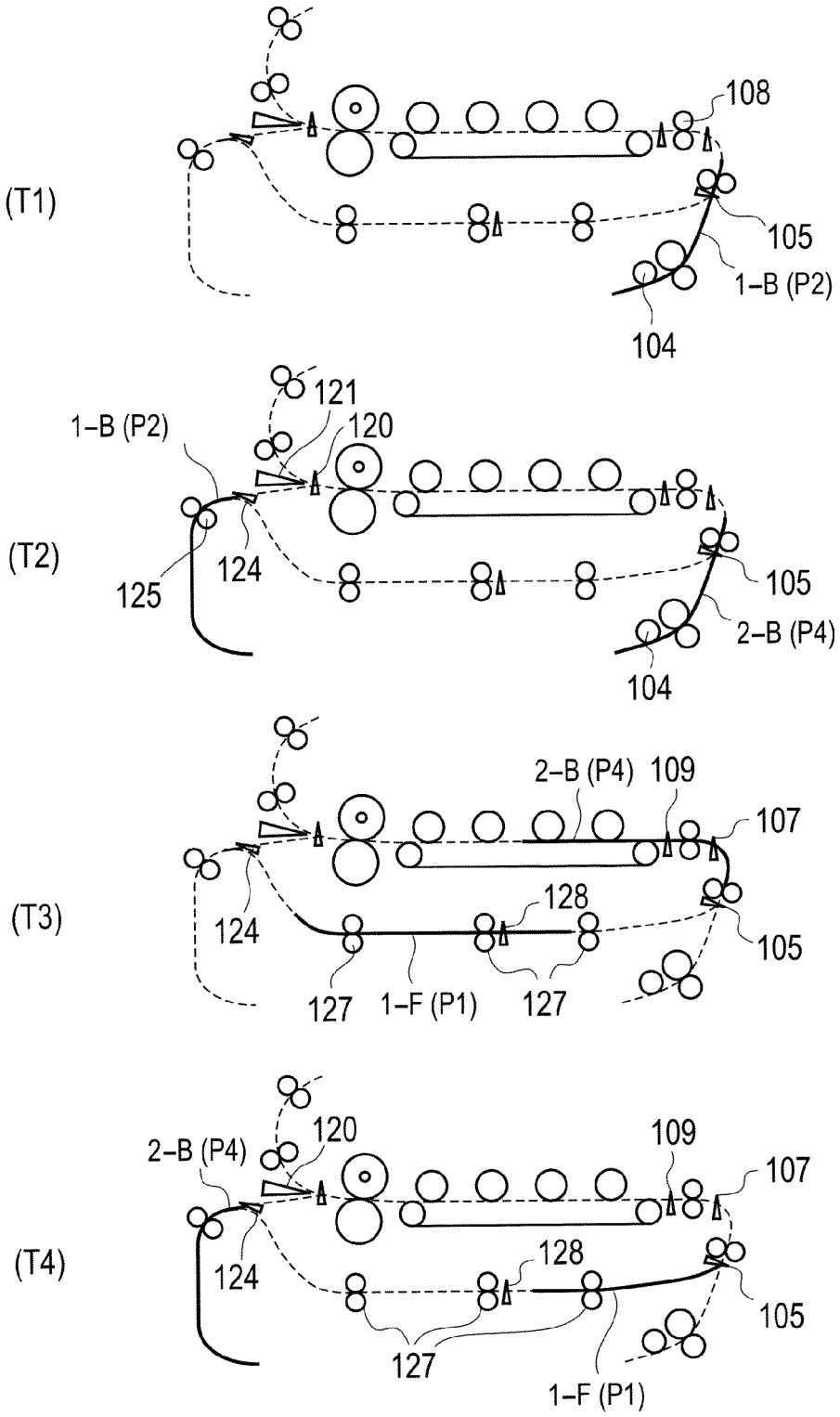
FIG. 6 is a diagram showing positions of sheets at respective times T1 to T4 in the time chart.

(Time T0 to T1, see FIG. 6 (T1))

When controller 60 receives an instruction for a double-sided printing, controller 60 starts a control for a double-sided printing operation. Namely, a temperature control is turned on to heat fusing unit 30 to a printable temperature. Also fuser motor 201 is turned onto rotate fuser roller 117 and discharge roller 122. The rotation of fuser roller 117 evens out the temperature of fuser roller 117. Next, ID motor 202 is turned on to rotate the rotating mechanism of ID device 113. Also belt motor 203 is turned on to rotate paper sheet transport belt 111. Also feed motor 204 and feed solenoid 205 are turned on to rotate paper-feeding roller 104 and second resist roller 108. With this operation, sheet P is fed to main medium transport path 80 by the rotation of paper-feeding roller 104. Note that, regarding this first sheet P, the second page of print data will be printed on the backside thereof and the first page of the print data will be printed on the front side thereof. Thus, this first sheet P is denoted in the drawings by 1-B (P2) which means the backside of the first sheet (Page 2). Next, the front end of sheet 1-B (P2) is detected by first inlet sensor 105.

(Time T1 to T2, see FIG. 6 (T2))

When the feeding of sheet 1-B (P2) is completed, feed solenoid 205 is turned off, so that paper-feeding roller 104 stops and first resist roller 106 rotates. Next, the front end of sheet 1-B (P2) is detected by second inlet sensor 107 and write sensor 109 sequentially. After that, the rear end of sheet 1-B (P2) is detected by first inlet sensor 105, second inlet sensor 107 and write sensor 109 sequentially. Next, after passing through image forming unit 20 and fusing unit 30, the front end of sheet 1-B (P2) is detected by discharge sensor 120. At this time, separator solenoid 208 is turned on so that separator 121 forms a route for leading sheet P to re-feed unit 40. Also re-feed motor 206 is driven in the reverse direction to rotate reverse roller 125 in the reverse direction so that sheet 1-B (P2) is drawn to reverse section 41. Next, the front end of sheet 1-B (P2) is detected by re-feed unit inlet sensor 124.

Next, feed solenoid 205 is turned on to drive paper-feeding roller 104 so that next sheet P is fed to main medium transport path 80. This new sheet P is denoted in the drawings by 2-B (P4) which means the backside of the second sheet (Page 4). Then, the front end of sheet 2-B (P4) is detected by first inlet sensor 105.

Then, the rear end of sheet 1-B (P2) is detected by discharge sensor 120. At this time, separator solenoid 208 is turned off so that separator 121 forms a route for transporting sheet P to discharge unit 50.

(Time T2 to T3, see FIG. 6 (T3))

When feeding sheet 2-B (P4) is completed, feed solenoid 205 is turned off, so that paper-feeding roller 104 stops and first resist roller 106 rotates. Next, as sheet 2-B (P4) is further transported, the front end of sheet 2-B (P4) is detected by second inlet sensor 107 and write sensor 109 sequentially. After that, the rear end of sheet 2-B (P4) is detected by first inlet sensor 105.

On the other hand, regarding to sheet 1-B (P2), the rear end of sheet 1-B (P2) is detected by re-feed unit inlet sensor 124. Detecting the rear end of sheet 1-B (P2) by re-feed unit inlet sensor 124 triggers drive of re-feed motor 206 in a normal direction. With this, sheet 1-B (P2) is transferred from reverse section 41 to re-feeding main path 42. As it is being transported from reverse section 41 to re-feeding main path 42, sheet 1-B (P2) is turned over. After sheet 1-B (P2) is turned over, the sheet is denoted in the drawings by 1-F (P1) which means the front side of the first sheet (Page 1). Next, re-feed clutch 207 is turned on to drive transport roller 127 so that sheet 1-F (P1) is further transported along re-feeding main path 42 toward the upstream portion of main medium transport path 80. After that, the front end of sheet 1-B (P2) is detected by re-feed unit front sensor 128.

(Time T3 to T4, FIG. 6 (T4))

The rear end of sheet 2-B (P4) is detected by second inlet sensor 107 and write sensor 109 sequentially. Next, the front end of sheet 2-B (P4) is detected by discharge sensor 20, after passing through image forming unit 20 and fusing unit 30. At this time, separator solenoid 208 is turned on, so that separator 121 forms the route for leading sheet P to re-feed unit 40. Also re-feed motor 206 is driven in a reverse direction to lead sheet 2-B (P4) to reverse section 41. Next, the front end of sheet 2-B (P4) is detected by re-feed unit inlet sensor 124. Then, the rear end of sheet 2-B (P4) is detected by discharge sensor 120. At this time, separator solenoid 208 is turned off so that separator 121 temporarily forms the route for transporting sheet P to discharge unit 50.

On the other hand, regarding to sheet 1-F (P1), as sheet 1-F (P1) is further transported toward the upstream portion of main medium transport path 80 by the rotation of transport roller 127, the rear end of sheet 1-F (P1) is detected by re-feed unit front sensor 128. After that, the front end of sheet 1-F (P1) is detected by first inlet sensor 105.

Figure 7:
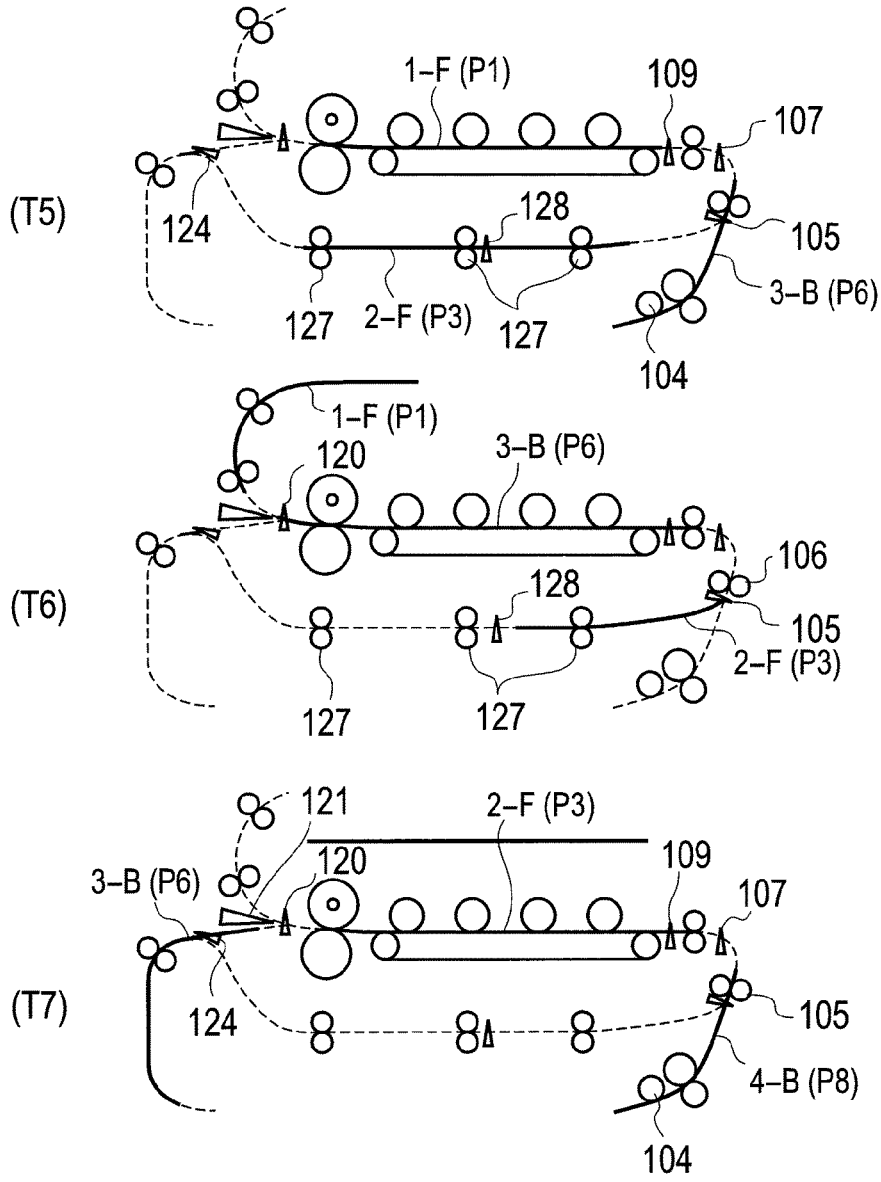
FIG. 7 is a diagram showing positions of sheets at respective times T5 to T7 in the time chart.

(Time T4 to T5, see FIG. 7 (T5))

Next, the front end of sheet 1-F (P1) is detected by second inlet sensor 107 and write sensor 109 sequentially. Then, the rear end of sheet 1-F (P1) is detected by first inlet sensor 105. At this time, feed solenoid 205 is turned on to drive paper-feeding roller 104 so that next sheet P is fed to main medium transport path 80. Note that this new supplied sheet P is denoted in the drawings by 3-B (P6) which means the backside of the third sheet (Page 6). Next, the front end of sheet 3-B (P6) is detected by first inlet sensor 105. Then, the rear end of sheet 1-F (P1) is detected by second inlet sensor 107 and write sensor 109 sequentially.

On the other hand, regarding to sheet 2-B (P4), the rear end of sheet 2-B (P4) is detected by re-feed unit inlet sensor 124. Detecting the rear end of sheet 2-B (P4) by re-feed unit inlet sensor 124 triggers turn off of re-feed clutch 207 to stop re-feeding motor 27 and then drive re-feed motor 206 in a normal direction. With this operation, sheet 2-B (P4) is transported from reverse section 41 to re-feeding main path 42. As it is being transported from reverse section 41 to re-feeding main path 42, sheet 2-B (P4) is turned over. After sheet 2-B (P4) is turned over, the sheet is denoted in the drawings by 2-F (P3) which means the front side of the second sheet (Page 3). Next, re-feed clutch 207 is turned on to drive transport roller 127 so that sheet 2-F (P3) is transported toward downstream of re-feeding main path 42. After that, the front end of sheet 2-F (P3) is detected by re-feed unit front sensor 128.

(Time T5 to T6, see FIG. 7 (T6))

At the time when the feeding of sheet 3-B (P6) is completed, feed solenoid 205 is turned off to stop paper-feeding roller 104 and drive first resist roller 106. Next, the front end of sheet 3-B (P6) is detected by second inlet sensor 107 and write sensor 109 sequentially. Next, the rear end of sheet 3-B (P6) is detected by first inlet sensor 105 and second inlet sensor 107 sequentially.

On the other hand, regarding to sheet 1-F (P1), after passing through image forming unit 20 and fusing unit 30, the front end of sheet 1-F (P1) is detected by discharge sensor 120. Next, as sheet 1-F (P1) is transported through discharge unit 50, the rear end of sheet 1-F (P1) is detected by discharge sensor 120. After that, sheet 1-F (P1) is discharged from printer 10.

On the other hand, regarding to sheet 2-F (P3), as sheet 2-F (P3) is further transported toward the upstream portion of main medium transport path 80 by the driven of transport roller 127, the rear end of sheet 2-F (P3) is detected by re-feed unit front sensor 128. After that, the front end of sheet 2-F (P3) is detected by first inlet sensor 105.

(Time T6 to T7, see FIG. 7 (T7))

Next, the front end of sheet 2-F (P3) is detected by second inlet sensor 107 and write sensor 109 sequentially. Then, the rear end of sheet 2-F (P3) is detected by first inlet sensor 105. At this time, feed solenoid 205 is turned on to drive paper-feeding roller 104 so that next sheet P is fed to main medium transport path 80. Note that the new sheet P is denoted in the drawings by 4-B (P8) which means the backside of fourth sheet (Page 8). Next, the front end of sheet 4-B (P8) is detected by first inlet sensor 105. Then, the rear end of sheet 2-F (P3) is detected by second inlet sensor 107.

On the other hand, regarding to sheet 3-B (P6), after passing through image forming unit 20 and fusing unit 30, the front end of sheet 3-B (P6) is detected by discharge sensor 120. At this time, separator solenoid 208 is turned on so that separator 121 forms the route for leading sheet P to re-feed unit 40. Re-feed motor 206 is driven in a reverse direction so that sheet 3-B (P6) is lead to reverse section 41. Re-feed clutch 207 is turned off to stop transport roller 127 as well. Then, the front end of sheet 3-B (P6) is detected by re-feed unit inlet sensor 124. After that, the rear end of sheet 3-B (P6) is detected by discharge sensor 120. At this time, separator solenoid 208 is turned off so that separator 121 forms the route for transporting sheet P to discharge unit 50.

Figure 8:
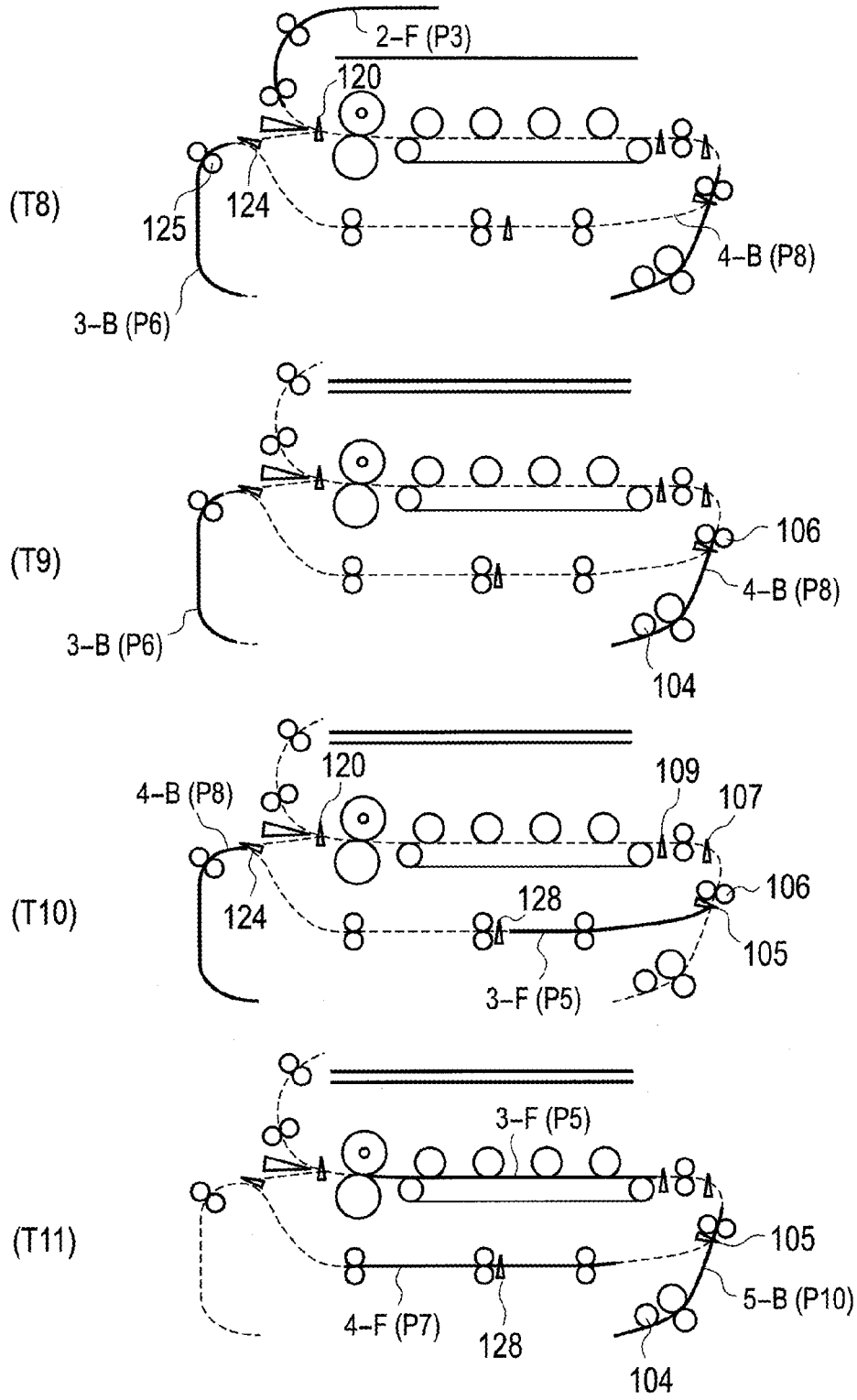
FIG. 8 is a diagram showing positions of sheets at respective times T8 to T11 in the time chart.

(Time T7 to T8, see FIG. 8 (T8))

At Time T7, temperature sensor 21 detects a temperature higher than a first predetermined temperature of 46° C. At this time, controller 60 stops the print operation and executes a heat release operation by suspending transport of heated sheet P which had been heated by fusing unit 30. Namely, feed motor 204 and feed solenoid 205 are turned off so as to halt the feeding of sheet 4-B (P8) which is being fed.

On the other hand, regarding to sheet 3-B (P6), the rear end of sheet 3-B (P6) is detected by re-feed unit inlet sensor 124. Then, re-feed motor 206 is turned off to stop the rotation of reverse roller, so that sheet 3-B (P6) is held by reverse roller 125 and kept near slit 126 provided to the body of printer 10. Thereby, heat applied in fusing unit 30 can be efficiently released.

On the other hand, regarding to sheet 2-F (P3), the rear end of sheet 2-F (P3) is detected by write sensor 109. After passing through image forming unit 20 and fusing unit 30, the front end of sheet 2-F (P3) is detected by discharge sensor 120. Next, as sheet 2-F (P3) is transported through discharge unit 50, the rear end of sheet 2-F (P3) is detected by discharge sensor 120. After that, sheet 2-F (P3) is discharged from printer 10.

At this time, the temperature control of fusing unit 30 is stopped, whereas fuser motor 201 is kept turned on in order to prevent temperature overshoot of fusing unit 30. Also ID motor 202 and belt motor 203 are turned off.

(Time T8 to T9, see FIG. 8 (T9))

Controller 60 waits until temperature sensor 21 detects temperature equal to or lower than a second predetermined temperature.

(Time T9 to T10, see FIG. 8 (T10))

At Time T9, temperature sensor 21 detects temperature equal to or lower than the second predetermined temperature of 44° C. At this time, controller 60 restarts the print operation. Namely, the temperature control of fusing unit 30 is turned on. Since the temperature control has been stopped only a short period of time, the temperature of fuser roller 117 soon reaches the printable temperature. Also ID motor 202 is turned on to rotate the rotating mechanism of ID device 113. Also belt motor 203 is turned on to rotate paper sheet transport belt 111. Also feed motor 204 and feed solenoid 205 is turned on to rotate paper-feeding roller 104 and second resist roller 108. With this operation, the feeding of sheet 4-B (P8) is restarted by the driven of paper-feeding roller 104.

At a time of a completion of the feeding of sheet 4-B (P8), feed solenoid 205 is turned off to stop paper-feeding roller 104 and drive first resist roller 106. Then, the front end of sheet 4-B (P8) is detected by second inlet sensor 107 and write sensor 109 sequentially. Then, the rear end of sheet 4-B (P8) is detected by first inlet sensor 105, second inlet sensor 107 and write sensor 109 sequentially.

On the other hand, at Time T9, that is, when temperature sensor 21 detects temperature equal to or lower than the second predetermined temperature of 44° C., re-feed motor 206 is driven in a normal direction. With this operation, sheet 3-B (P6) is transported from reverse section 41 to re-feeding main path 42, while being turned over. Note that after sheet 3-B (P6) is turned over, the sheet is denoted in the drawings by 3-F (P5) which means the front side of the third sheet (Page 5). Next, re-feed clutch 207 is turned on to rotate transport roller 127. By the rotation of transport roller 127, sheet 3-F (P5) is transported along re-feeding main path 42 toward the upstream portion of main medium transport path 80. Then, the front end of sheet 3-F (P5) is detected by re-feed unit front sensor 128. Then, the rear end of sheet 3-F (P5) is detected by re-feed unit front sensor 128. Then, the front end of sheet 3-F (P5) is detected by first inlet sensor 105.

On the other hand, regarding to sheet 4-B (P8), the front end of sheet 4-B (P8) is detected by discharge sensor 120, after passing through image forming unit 20 and fusing unit 30. At this time, separator solenoid 208 is turned on so that separator 121 forms the route for leading sheet P to re-feed unit 40. Also re-feed motor 206 is driven in a reverse direction so that sheet 4-B (P8) is drawn into reverse section 41. Then, the front end of sheet 4-B (P8) is detected by re-feed unit inlet sensor 124. Then, the rear end of sheet 4-B (P8) is detected by discharge sensor 120. At this time, separator solenoid 208 is turned off so that separator 121 forms a route for transporting sheet P to discharge unit 50.

(Time T10 to T11, see FIG. 8 (T11))

The front end of sheet 3-F (P5) is detected by second inlet sensor 107 and write sensor 109 sequentially. Then, the rear end of sheet 3-F (P5) is detected by first inlet sensor 105. At this time, feed solenoid 205 is turned on so that next sheet P is supplied by a drive of paper-feeding roller 104. This new supplied sheet P is denoted in the drawings by 5-B (P10)

which means the backside of the fifth sheet (Page 10). Then, the front end of sheet 5-B (P10) is detected by first inlet sensor 105. Next, the rear end of sheet 3-F (P5) is detected by second inlet sensor 107 and write sensor 109 sequentially.

On the other hand, the rear end of sheet 4-B (P8) is detected by re-feed unit inlet sensor 124. Detecting sheet 4-B (P8) by re-feed unit inlet sensor 124 triggers turn off of re-feed clutch 207 to stop transport roller 127 and then to drive re-feed motor 206 in a normal direction. With this operation, sheet 4-F (P7) is led from reverse section 41 to re-feeding main path 42, so as to be turned over. Note that after sheet 4-B (P8) is turned over, the sheet is denoted in the drawings by 4-F (P7) which means the front side of the fourth sheet (Page 7). Then, re-feed clutch 207 is turned on to rotate transport roller 127 so that 4-F (P7) is transported along re-feeding main path 42 toward the upstream portion of main medium transport path 80. After that, the front end of sheet 4-F (P7) is detected by re-feed unit front sensor 128.

Figure 9:
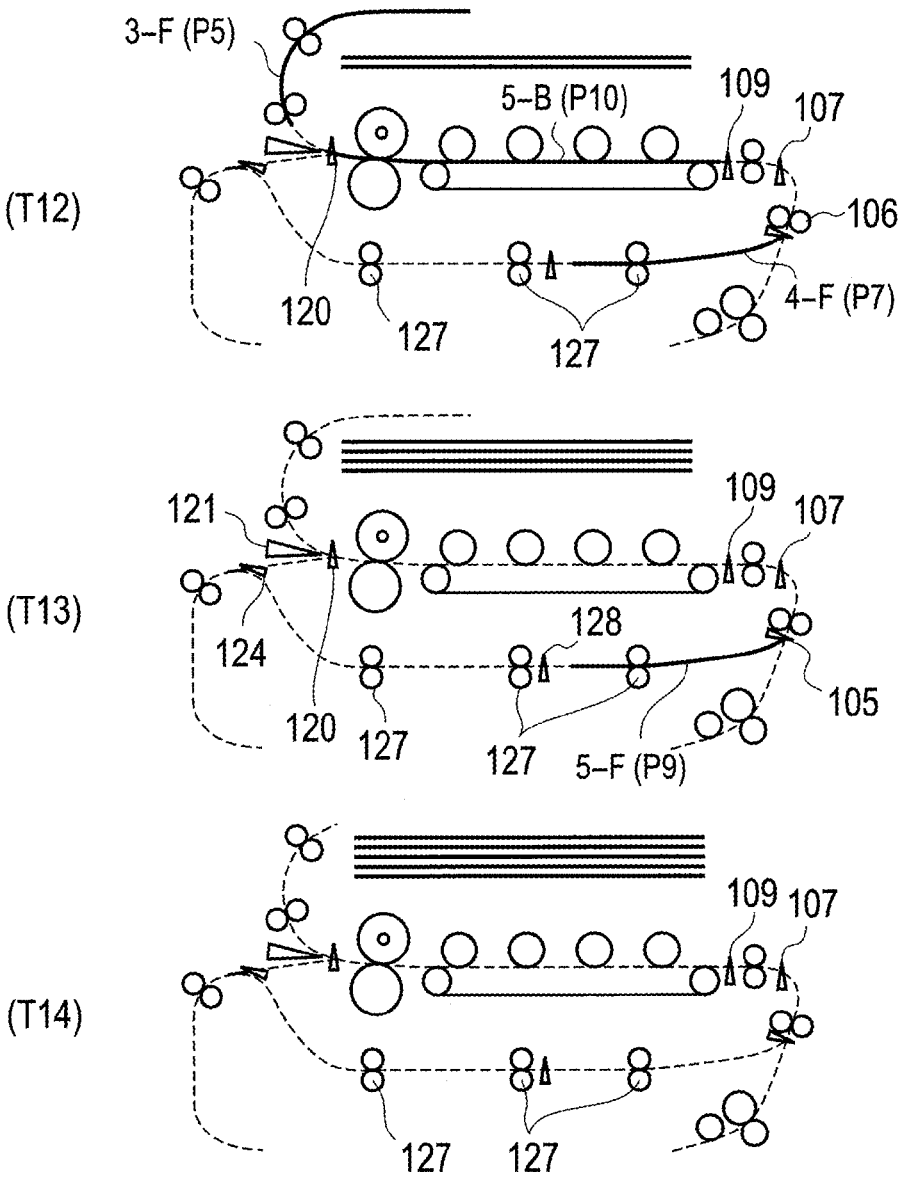
FIG. 9 is a diagram showing positions of sheets at respective times T12 to T14 in the time chart.

(Time T11 to T12, see FIG. 9 (T12))

At a time of a completion of the feeding of sheet 5-B (P10), feed solenoid 205 is turned off to stop paper-feeding roller 104 and rotate first resist roller 106. Then, the front end of sheet 5-B (P10) is detected by second inlet sensor 107 and write sensor 109 sequentially. Then, the rear end of sheet 5-B (P10) is detected by first inlet sensor 105 and second inlet sensor 107 sequentially.

On the other hand, regarding to sheet 3-F (P5), the front end of sheet 3-F (P5) is detected by discharge sensor 120, after passing through image forming unit 20 and fusing unit 30. Next, as sheet 3-F (P5) is transported through discharge unit 50, the rear end of sheet 3-F (P5) is detected by discharge sensor 120. After that, sheet 3-F (P5) is discharged from printer 10.

On the other hand, regarding sheet 4-F (P7), as sheet 4-F (P7) is further transported toward the upstream portion of main medium transport path 80 by the rotation of transport roller 127, the rear end of sheet 4-F (P7) is detected by re-feed unit front sensor 128. After that, the front end of sheet 4-F (P7) is detected by first inlet sensor 105.

(Time T12 to T13, see FIG. 9 (T13))

Re-feed clutch 207 is turned off to stop transport roller 127. The front end of sheet 5-B (P10) is detected by discharge sensor 120, after passing through image forming unit 20 and fusing unit 30. At this time, separator solenoid 208 is turned on so that separator 121 forms the route for leading sheet P to re-feed unit 40. Next, re-feed motor 206 is driven in a reverse direction, so that sheet 5-B (P10) is led into reverse section 41. Also re-feed clutch 207 is turns off to temporarily stop transport roller 127. Then, the front end of sheet 5-B (P10) is detected by re-feed unit inlet sensor 124. After that, the rear end of sheet 5-B (P10) is detected by discharge sensor 120. At this time, separator solenoid 208 is turned off so that separator 121 forms the route for transporting sheet P to discharge unit 50.

On the other hand, regarding sheet 5-B (P10), the rear end of sheet 5-B (P10) is detected by re-feed unit inlet sensor 124. The detection of the rear end of sheet 5-B (P10) by re-feed unit inlet sensor 124 triggers drive of re-feed motor 206 in a normal direction. With this operation, sheet 5-B (P10) is led from reverse section 41 to re-feeding main path 42, so as to be turned over. Then, re-feed clutch 207 is turned on to rotate transport roller 127. Then, the front end of sheet 5-B (P10) is detected by re-feed unit front sensor 128. Note that after sheet 5-B (P10) is turned over in re-feed unit 40, the sheet is denoted in the drawings by 5-F (P9) which means the front side of the fifth sheet (Page 9). By the rotation of transport roller 127, sheet 5-F (P9) is re-fed along re-feeding main path 42 toward the upstream portion of main medium transport path 80. Then, the rear end of sheet 5-F (P9) is detected by re-feed unit front sensor 128. After that, the front end of sheet 5-F (P9) is detected by first inlet sensor 105.

On the other hand, regarding to 4-F (P7), the front end of sheet 4-F (P7) is detected by second inlet sensor 107 and write sensor 109 sequentially. Then, the rear end of Back 4 (7P) is detected by first inlet sensor 105, second inlet sensor 107 and write sensor 109 sequentially. Then, after passing through image forming unit 20 and fusing unit 30, the front end of sheet 4-F (P7) is detected by discharge sensor 120. Then, as sheet 4-F (P7) is transported through discharge unit 50, the rear end of sheet 4-F (P7) is detected by discharge sensor 120. After that, sheet 4-F (P7) is discharged from printer 10.

(Time T13 to T14, see FIG. 9 (T14))

Next, re-feed clutch 207 is turned off to stop transport roller 127. Then, the front end of sheet 5-F (P9) is detected by second inlet sensor 107 and write sensor 109 sequentially. Next, the rear end of sheet 5-F (P9) is detected by first inlet sensor 105, second inlet sensor 107 and write sensor 109 sequentially. Then, the front end of sheet 5-F (P9) is detected by discharge sensor 120, after passing through image forming unit 20 and fusing unit 30. Then, as sheet 5-F (P9) is transported through discharge unit 50, the rear end of sheet 5-F (P9) is detected by discharge sensor 120. After that sheet 5-F (P9) is discharged from printer 10.

Next, the temperature control of fusing unit 30 is turned off. Also ID motor 202 is turned off to stop the rotating mechanism of ID device 113. Also belt motor 203 is turned off to stop paper sheet transport belt 111. Also feed motor 204 is turned off to stop first resist roller 106 and second resist roller 108. Then, fuser motor 201 is turned off to stop the fuser roller 117 and discharge roller 122.

As described above, the first embodiment has temperature sensor 21 detecting temperature around ID device 113, and holds heated and image-fixed sheet P in reverse section 41 to cool heated and image-fixed sheet P, when the temperature sensor 21 detects a temperature equal to or higher than the predetermined temperature. With this, printing can be executed without changing image-forming conditions. Therefore, print quality can be improved while maintaining the image quality. Further, the first embodiment holds heated and image-heated sheet P in a place having high radiation, that is, in vicinity of slits 126. This further decreases raising temperature in ID device 113, when ID device 113 prints the backside of sheet P.

Note that, according to an image forming apparatus that does not employ the invention, after long period operation, inside temperature of the image forming apparatus goes up due to heat generated by a fusing unit. Further, according to the image forming apparatus that does not employ the invention, a heated and image-fixed sheet that had been heated by the fusing unit is transported inside the image forming apparatus and re-fed to an image forming unit without being cooled, and thereby, inside temperature of the image forming apparatus stay high. This causes toner in the image forming unit to cake or become lumps so as to deteriorate the image forming quality.

Second Embodiment

Figure 10:
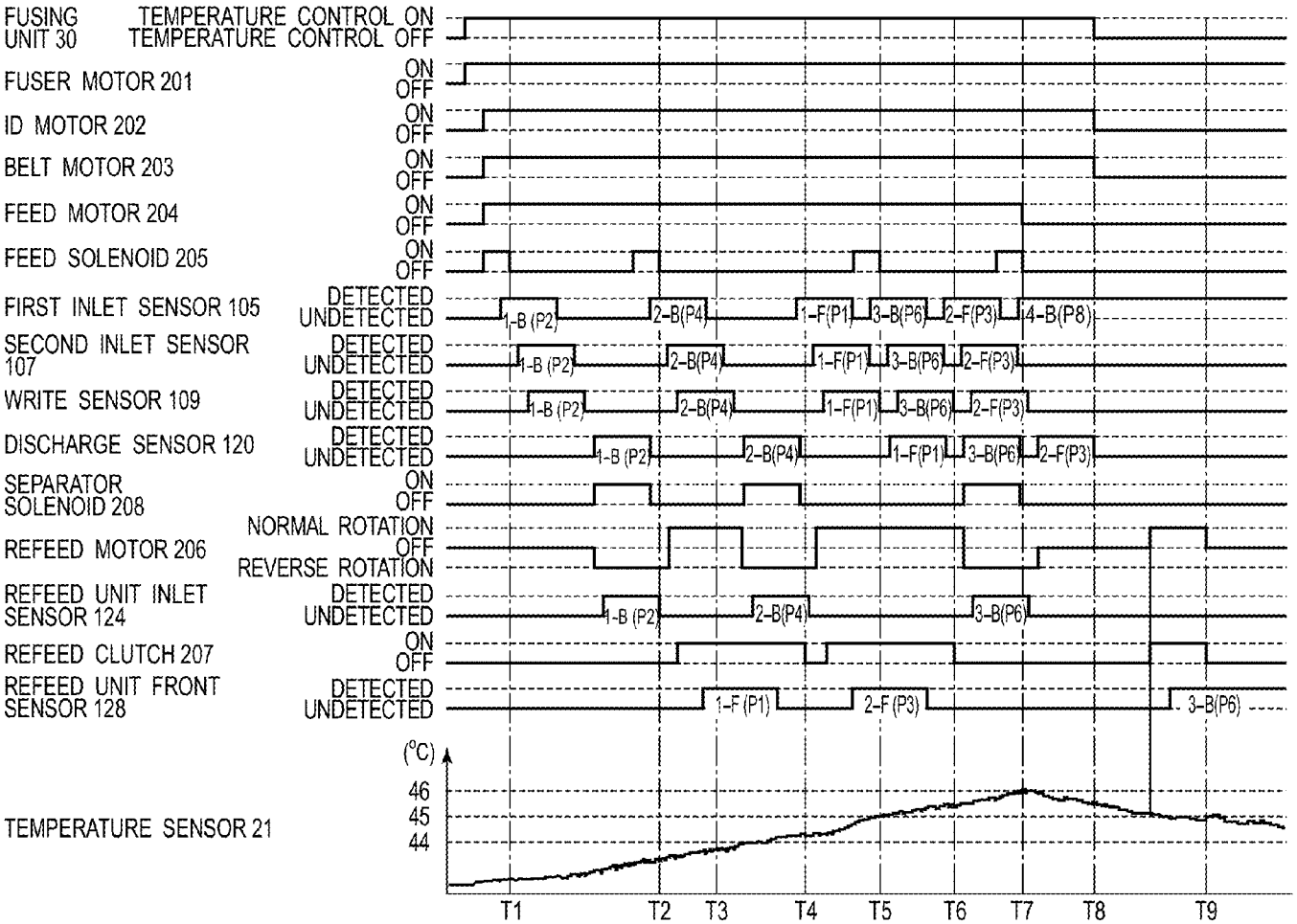
FIG. 10 is a part of a time chart of an operation of a printer according to a second embodiment, showing times T1 to T9.
Figure 11:
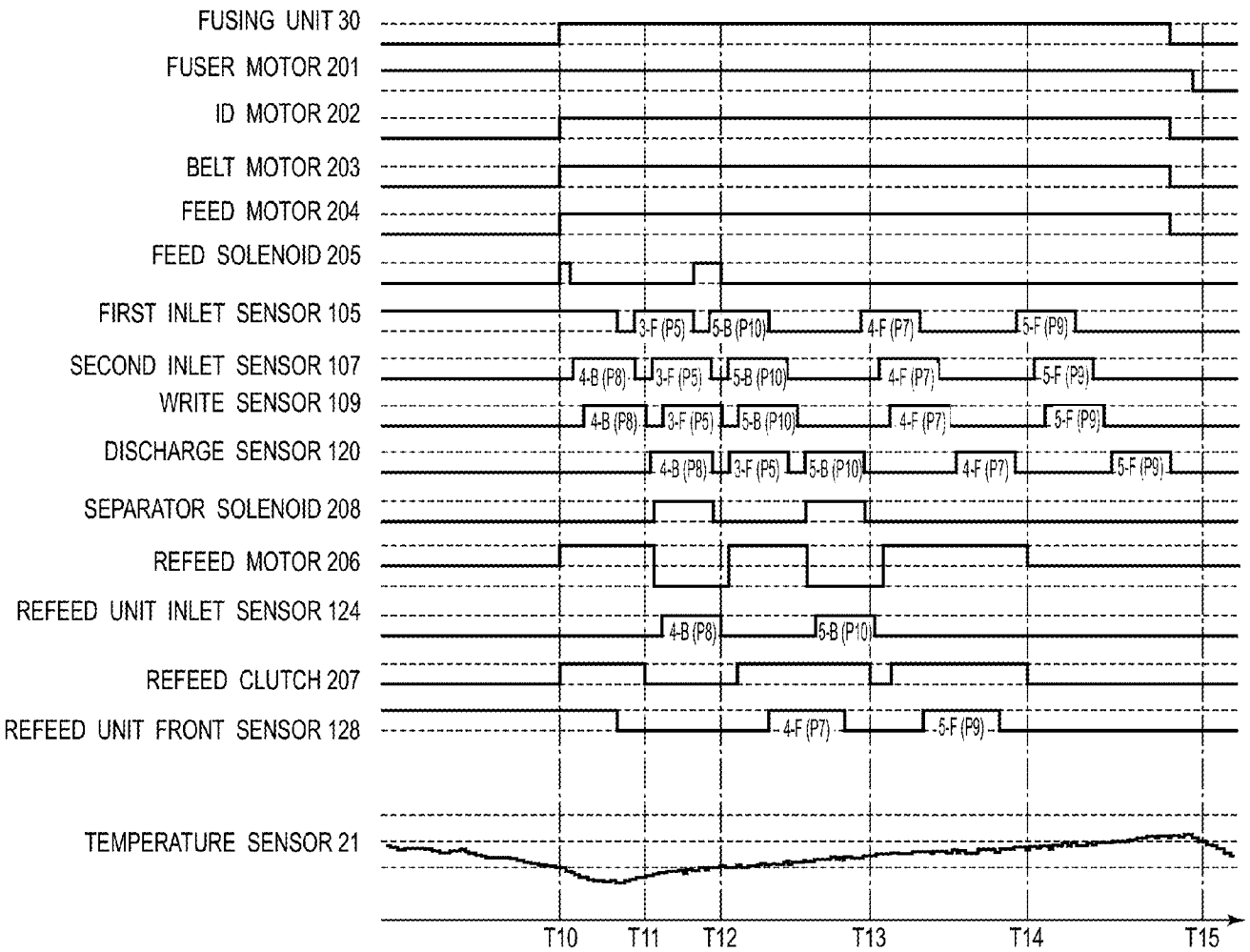
FIG. 11 is a part of the time chart of the operation of the printer according to the second embodiment, showing times T10 to 15.
Figure 12:
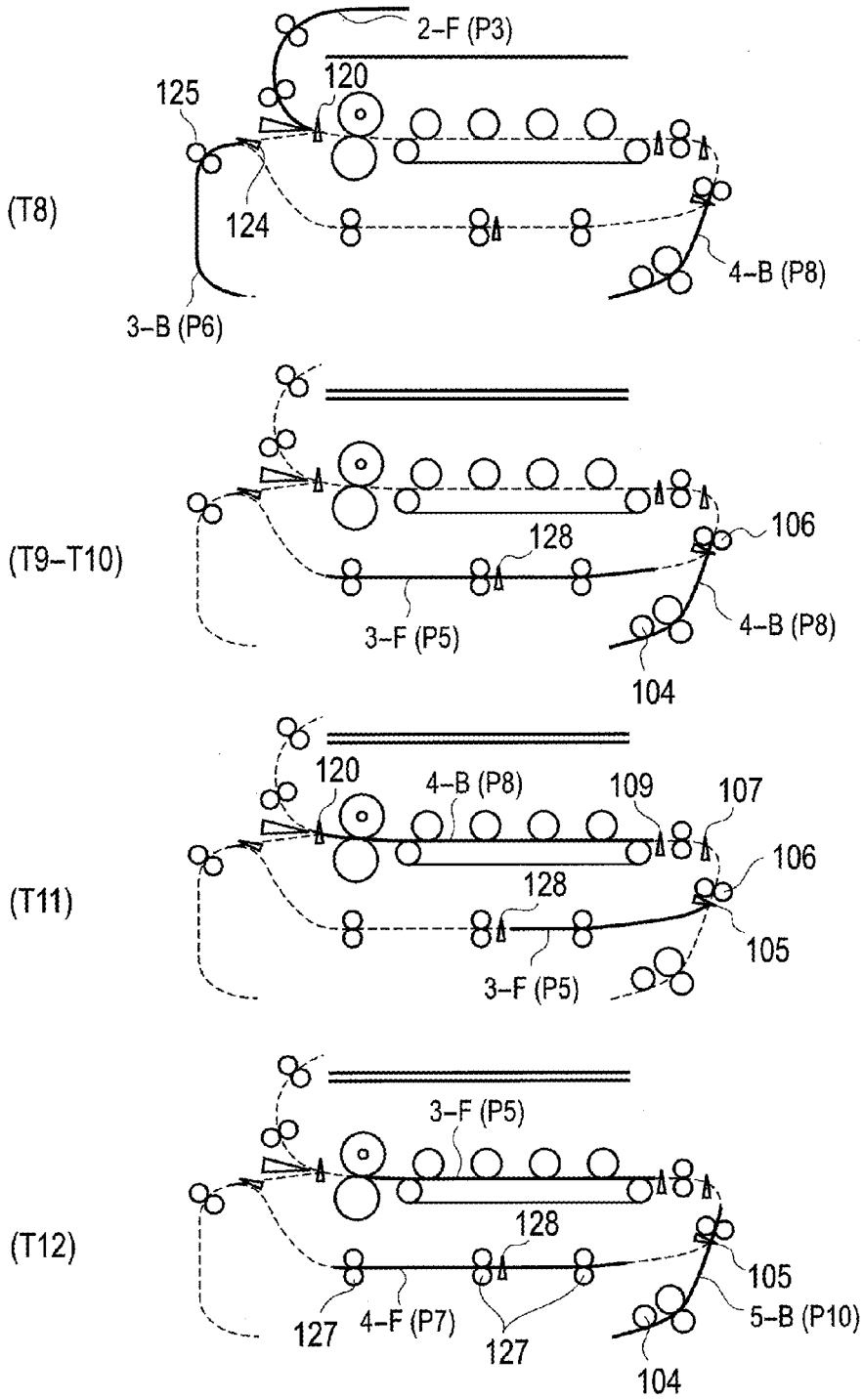
FIG. 12 is a diagram showing positions of sheets at respective times T8 to T12 in the time chart.
Figure 13:
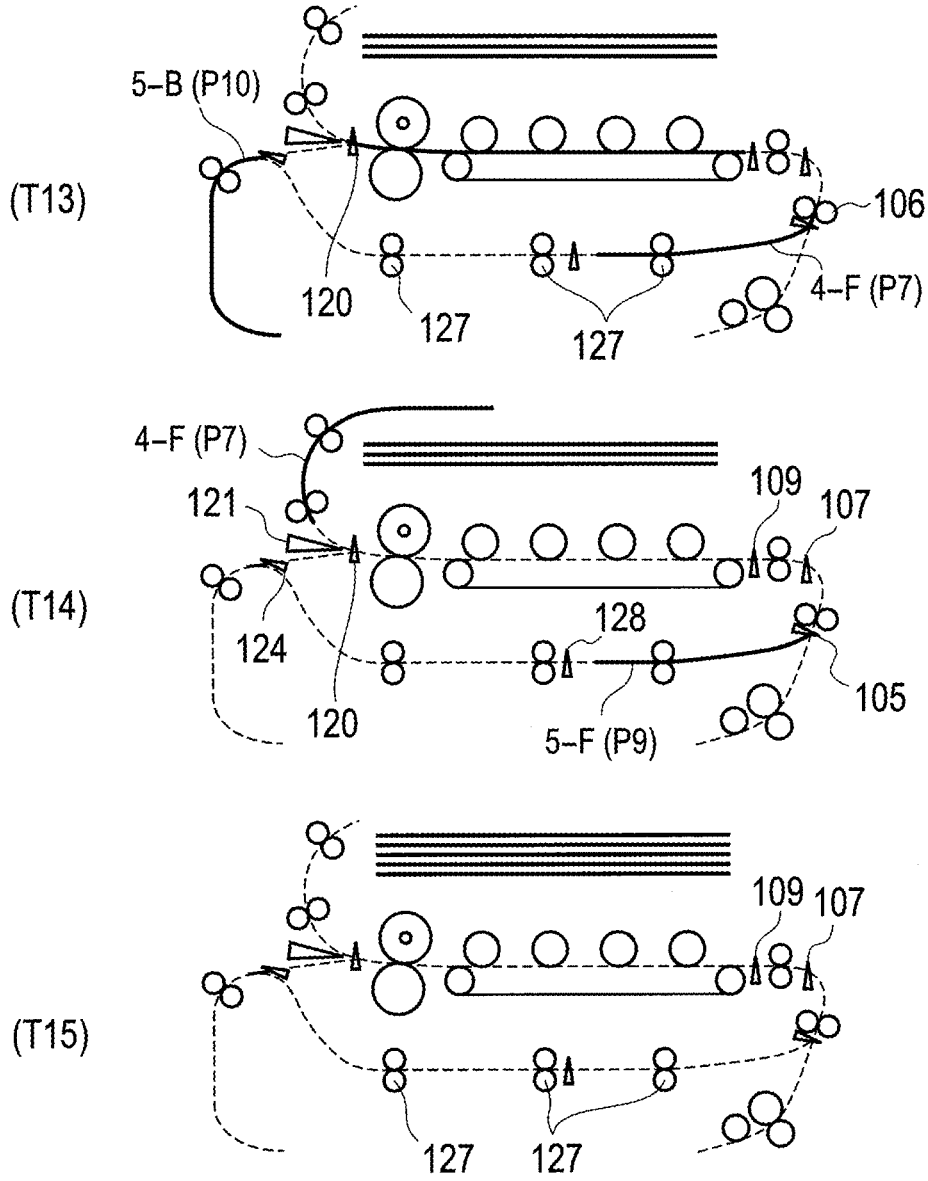
FIG. 13 is a diagram showing positions of sheets at respective times T13 to T15 in the time chart.

A second embodiment of the present invention will be described. The configuration of the second embodiment is the same as that of the first embodiment, so the description of the structure of the second embodiment will be omitted by incorporating the description of the structure of first embodiment into the second embodiment. Hereinafter, operations of printer 10 according to the second embodiment will be described. FIGS. 10 and 11 are time charts of operations of printer 10 according to the second embodiment. The operations will be described following the time series shown in FIGS. 10 and 11. Further, FIGS. 12 and 13 are explanatory diagrams showing how sheet P is transported in the respective time T8 to T15 in the time charts of FIGS. 10 and 11. The explanatory diagrams showing how sheet P is transported in the respective time T1 to T7 are the same as those of FIGS. 6 and 7, so those will be described with reference to FIGS. 6 and 7.

(Time T0 to T1, see FIG. 6 (T1))

When controller 60 receives an instruction for a double-sided printing, controller 60 starts a control for a double-sided printing operation. Namely, a temperature control is turned on to heat fusing unit 30 to a printable temperature. Also fuser motor 201 is turned onto rotate fuser roller 117 and discharge roller 122. The rotation of fuser roller 117 evens out the temperature of fuser roller 117. Next, ID motor 202 is turned on to rotate the rotating mechanism of ID device 113. Also belt motor 203 is turned on to rotate paper sheet transport belt 111. Also feed motor 204 and feed solenoid 205 are turned on to rotate paper-feeding roller 104 and second resist roller 108. With this operation, sheet P is fed to main medium transport path 80 by the rotation of paper-feeding roller 104. Note that, regarding this first sheet P, the second page of print data will be printed on the backside thereof and the first page of the print data will be printed on the front side thereof. Thus, this first sheet P is denoted in the drawings by 1-B (P2) which means the backside of the first sheet (Page 2). Next, the front end of sheet 1-B (P2) is detected by first inlet sensor 105.

(Time T1 to T2, see FIG. 6 (T2))

When the feeding of sheet 1-B (P2) is completed, feed solenoid 205 is turned off, so that paper-feeding roller 104 stops and first resist roller 106 rotates. Next, the front end of sheet 1-B (P2) is detected by second inlet sensor 107 and write sensor 109 sequentially. After that, the rear end of sheet 1-B (P2) is detected by first inlet sensor 105, second inlet sensor 107 and write sensor 109 sequentially. Next, after passing through image forming unit 20 and fusing unit 30, the front end of sheet 1-B (P2) is detected by discharge sensor 120. At this time, separator solenoid 208 is turned on so that separator 121 forms a route for leading sheet P to re-feed unit 40. Also re-feed motor 206 is driven in the reverse direction to rotate reverse roller 125 in the reverse direction so that sheet 1-B (P2) is drawn to reverse section 41. Next, the front end of sheet 1-B (P2) is detected by re-feed unit inlet sensor 124.

Next, feed solenoid 205 is turned on to drive paper-feeding roller 104 so that next sheet P is fed to main medium transport path 80. This new sheet P is denoted in the drawings by 2-B (P4) which means the backside of the second sheet (Page 4). Then, the front end of sheet 2-B (P4) is detected by first inlet sensor 105.

Then, the rear end of sheet 1-B (P2) is detected by discharge sensor 120. At this time, separator solenoid 208 is turned off so that separator 121 forms a route for transporting sheet P to discharge unit 50.

(Time T2 to T3, see FIG. 6 (T3))

When feeding sheet 2-B (P4) is completed, feed solenoid 205 is turned off, so that paper-feeding roller 104 stops and first resist roller 106 rotates. Next, as sheet 2-B (P4) is further transported, the front end of sheet 2-B (P4) is detected by second inlet sensor 107 and write sensor 109 sequentially. After that, the rear end of sheet 2-B (P4) is detected by first inlet sensor 105.

On the other hand, regarding to sheet 1-B (P2), the rear end of sheet 1-B (P2) is detected by re-feed unit inlet sensor 124. Detecting the rear end of sheet 1-B (P2) by re-feed unit inlet sensor 124 triggers drive of re-feed motor 206 in a normal direction. With this, sheet 1-B (P2) is transferred from reverse section 41 to re-feeding main path 42. As it is being transported from reverse section 41 to re-feeding main path 42, sheet 1-B (P2) is turned over. After sheet 1-B (P2) is turned over, the sheet is denoted in the drawings by 1-F (P1) which means the front side of the first sheet (Page 1). Next, re-feed clutch 207 is turned on to drive transport roller 127 so that sheet 1-F (P1) is further transported along re-feeding main path 42 toward the upstream portion of main medium transport path 80. After that, the front end of sheet 1-B (P2) is detected by re-feed unit front sensor 128.

(Time T3 to T4, FIG. 6 (T4))

The rear end of sheet 2-B (P4) is detected by second inlet sensor 107 and write sensor 109 sequentially. Next, the front end of sheet 2-B (P4) is detected by discharge sensor 20, after passing through image forming unit 20 and fusing unit 30. At this time, separator solenoid 208 is turned on, so that separator 121 forms the route for leading sheet P to re-feed unit 40. Also re-feed motor 206 is driven in a reverse direction to lead sheet 2-B (P4) to reverse section 41. Next, the front end of sheet 2-B (P4) is detected by re-feed unit inlet sensor 124. Then, the rear end of sheet 2-B (P4) is detected by discharge sensor 120. At this time, separator solenoid 208 is turned off so that separator 121 temporarily forms the route for transporting sheet P to discharge unit 50.

On the other hand, regarding to sheet 1-F (P1), as sheet 1-F (P1) is further transported toward the upstream portion of main medium transport path 80 by the rotation of transport roller 127, the rear end of sheet 1-F (P1) is detected by re-feed unit front sensor 128. After that, the front end of sheet 1-F (P1) is detected by first inlet sensor 105.

(Time T4 to T5, see FIG. 7 (T5))

Next, the front end of sheet 1-F (P1) is detected by second inlet sensor 107 and write sensor 109 sequentially. Then, the rear end of sheet 1-F (P1) is detected by first inlet sensor 105. At this time, feed solenoid 205 is turned on to drive paper-feeding roller 104 so that next sheet P is fed to main medium transport path 80. Note that this new supplied sheet P is denoted in the drawings by 3-B (P6) which means the backside of the third sheet (Page 6). Next, the front end of sheet 3-B (P6) is detected by first inlet sensor 105. Then, the rear end of sheet 1-F (P1) is detected by second inlet sensor 107 and write sensor 109 sequentially.

On the other hand, regarding to sheet 2-B (P4), the rear end of sheet 2-B (P4) is detected by re-feed unit inlet sensor 124. Detecting the rear end of sheet 2-B (P4) by re-feed unit inlet sensor 124 triggers turn off of re-feed clutch 207 to stop re-feeding motor 27 and then drive re-feed motor 206 in a normal direction. With this operation, sheet 2-B (P4) is transported from reverse section 41 to re-feeding main path 42. As it is being transported from reverse section 41 to re-feeding main path 42, sheet 2-B (P4) is turned over. After sheet 2-B (P4) is turned over, the sheet is denoted in the drawings by 2-F (P3) which means the front side of the second sheet (Page 3). Next, re-feed clutch 207 is turned on to drive transport roller 127 so that sheet 2-F (P3) is transported toward downstream of re-feeding main path 42. After that, the front end of sheet 2-F (P3) is detected by re-feed unit front sensor 128.

(Time T5 to T6, see FIG. 7 (T6))

At the time when the feeding of sheet 3-B (P6) is completed, feed solenoid 205 is turned off to stop paper-feeding roller 104 and drive first resist roller 106. Next, the front end of sheet 3-B (P6) is detected by second inlet sensor 107 and write sensor 109 sequentially. Next, the rear end of sheet 3-B (P6) is detected by first inlet sensor 105 and second inlet sensor 107 sequentially.

On the other hand, regarding to sheet 1-F (P1), after passing through image forming unit 20 and fusing unit 30, the front end of sheet 1-F (P1) is detected by discharge sensor 120. Next, as sheet 1-F (P1) is transported through discharge unit 50, the rear end of sheet 1-F (P1) is detected by discharge sensor 120. After that, sheet 1-F (P1) is discharged from printer 10.

On the other hand, regarding to sheet 2-F (P3), as sheet 2-F (P3) is further transported toward the upstream portion of main medium transport path 80 by the driven of transport roller 127, the rear end of sheet 2-F (P3) is detected by re-feed unit front sensor 128. After that, the front end of sheet 2-F (P3) is detected by first inlet sensor 105.

(Time T6 to T7, see FIG. 7 (T7))

Next, the front end of sheet 2-F (P3) is detected by second inlet sensor 107 and write sensor 109 sequentially. Then, the rear end of sheet 2-F (P3) is detected by first inlet sensor 105. At this time, feed solenoid 205 is turned on to drive paper-feeding roller 104 so that next sheet P is fed to main medium transport path 80. Note that the new sheet P is denoted in the drawings by 4-B (P8) which means the backside of fourth sheet (Page 8). Next, the front end of sheet 4-B (P8) is detected by first inlet sensor 105. Then, the rear end of sheet 2-F (P3) is detected by second inlet sensor 107.

On the other hand, regarding to sheet 3-B (P6), after passing through image forming unit 20 and fusing unit 30, the front end of sheet 3-B (P6) is detected by discharge sensor 120. At this time, separator solenoid 208 is turned on so that separator 121 forms the route for leading sheet P to re-feed unit 40. Re-feed motor 206 is driven in a reverse direction so that sheet 3-B (P6) is lead to reverse section 41. Re-feed clutch 207 is turned off to stop transport roller 127 as well. Then, the front end of sheet 3-B (P6) is detected by re-feed unit inlet sensor 124. After that, the rear end of sheet 3-B (P6) is detected by discharge sensor 120. At this time, separator solenoid 208 is turned off so that separator 121 forms the route for transporting sheet P to discharge unit 50.

(Time T7 to T8, see FIG. 8 (T8))

At Time T7, temperature sensor 21 detects a temperature higher than a first predetermined temperature of 46° C. At this time, controller 60 stops the print operation and executes a heat release operation by suspending transport of heated sheet P that had been heated by fusing unit 30. Namely, feed motor 204 and feed solenoid 205 are turned off so as to halt the feeding of sheet 4-B (P8) which is being fed.

On the other hand, regarding to sheet 3-B (P6), the rear end of sheet 3-B (P6) is detected by re-feed unit inlet sensor 124. Then, re-feed motor 206 is turned off to stop the rotation of reverse roller, so that sheet 3-B (P6) is held by reverse roller 125 and kept near slit 126 provided to the body of printer 10. Thereby, heat applied in fusing unit 30 can be efficiently released.

On the other hand, regarding to sheet 2-F (P3), the rear end of sheet 2-F (P3) is detected by write sensor 109. After passing through image forming unit 20 and fusing unit 30, the front end of sheet 2-F (P3) is detected by discharge sensor 120. Next, as sheet 2-F (P3) is transported through discharge unit 50, the rear end of sheet 2-F (P3) is detected by discharge sensor 120. After that, sheet 2-F (P3) is discharged from printer 10.

At this time, the temperature control of fusing unit 30 is stopped, whereas fuser motor 201 is kept turned on in order to prevent temperature overshoot of fusing unit 30. Also ID motor 202 and belt motor 203 are turned off.

(Time T8 to T9, see FIG. 12 (T9-T10))

Controller 60 waits until temperature sensor 21 detects temperature lower than a third predetermined temperature.

When temperature sensor 21 detects temperature equal to or lower than the third predetermined temperature of 45° C., re-feed motor 206 is driven in a normal direction and re-feed clutch 207 is turned on. With this operation, sheet 3-B (P6) is transported from reverse section 41 to re-feeding main path 42. Note that as it is transported from reverse section 41 to re-feeding main path 42, sheet 3-B (P6) is turned over. After sheet 3-B (P6) is turned over, the sheet is denoted in the drawings by 3-F (P5) which means the front side of the third sheet (Page 5). Next, the front end of sheet 3-F (P5) is detected by re-feed unit front sensor 128.

(Time T9 to T10, see FIG. 12 (T9-T10))

Next, re-feed motor 206 is turned off and re-feed clutch 207 is turned off. With this operation, sheet 3-F (P5) is held horizontally straight on flat section 42*a* of re-feeding main path 42, so as to straighten the curled sheet that had been hold in a curl shape in reverse section 41. Sheet 3-F (P5) will be held on flat section 42*a* of re-feeding main path 42 until a further lower value is detected by temperature sensor 21.

(Time T10 to T11, see FIG. 12 (T11))

At Time T10, temperature sensor 21 detects temperature equal to or lower than the second predetermined temperature of 44° C. At this time controller 60 restarts printing operation. Namely, the temperature control of fusing unit 30 is turned on. Since the temperature control has been stopped only a short period of time, the temperature of fuser roller 117 soon reaches the printable temperature. Also ID motor 202 is turned on to rotate the rotating mechanism of ID device 113. Also belt motor 203 is turned on to rotate paper sheet transport belt 111. Also feed motor 204 and feed solenoid 205 are turned on to rotate paper-feeding roller 104 and second resist roller 108. With this operation, the feeding of sheet 4-B (P8) is restarted by the rotation of paper-feeding roller 104.

At the time of the completion of the feeding of sheet 4-B (P8), feed solenoid 205 is turned off to stop paper-feeding roller 104 and rotate first resist roller 106. Then, the front end of sheet 4-B (P8) is detected by second inlet sensor 107 and write sensor 109 sequentially. After that, the rear end of sheet 4-B (P8) is detected by first inlet sensor 105, second inlet sensor 107 and write sensor 109 sequentially.

On the other hand, at Time T10, that is, when temperature sensor 21 detects temperature equal to or lower than the second predetermined temperature of 44° C., re-feed motor 206 is activated to rotate in a normal direction and re-feed clutch 207 is turned on to rotate transport roller 127 as well. With this operation, sheet 3-F (P5) is re-fed toward the upstream portion of main medium transport path 80 by the rotation of transport roller 127. Then, the rear end of sheet 3-F (P5) is detected by re-feed unit front sensor 128. Next, the front end of sheet 3-F (P5) is detected by first inlet sensor 105. After that, re-feed clutch 207 is turned off.

(Time T11 to T12, see FIG. 12 (T12))

After passing through image forming unit 20 and fusing unit 30, the front end of sheet 4-B (P8) is detected by discharge sensor 120. At this time, separator solenoid 208 is turned on so that separator 121 forms the route for leading sheet P to re-feed unit 40. Also re-feed motor 206 is activated to rotate in a reverse direction so that sheet 4-B (P8) is lead to reverse section 41. Then, the front end of sheet 4-B (P8) is detected by re-feed unit inlet sensor 124. After that, the rear end of sheet 4-B (P8) is detected by discharge sensor 120. At this time, separator solenoid 208 is turned off so that separator 121 forms the route for leading sheet P to discharge unit 50.

Next, the rear end of sheet 4-B (P8) is detected by re-feed unit inlet sensor 124. Detecting the rear end of sheet 4-B (P8) by re-feed unit inlet sensor 124 triggers drive of re-feed motor 206 in a normal direction so that sheet 4-B (P8) is transported from reverse section 41 to re-feeding main path 42. Note that as it is being transported from reverse section to re-feeding main path 42, sheet 4-B (P8) is turned over. After sheet 4-B (P8) is turned over, the sheet is denoted in the drawings by 4-F (P7) which means the front side of the fourth sheet (Page 7). Next, re-feed clutch 207 is turned on to rotate transport roller 127. After that, the front end of sheet 4-F (P7) is detected by re-feed unit front sensor 128.

(Time T12 to T13, see FIG. 13 (T13))

On the other hand, regarding 5-B (P10), at the time of completion of the feeding of sheet 5-B (P10), feed solenoid 205 is turned off to stop paper-feeding roller 104 and to rotate first resist roller 106. Then, the front end of sheet 5-B (P10) is detected by second inlet sensor 107 and write sensor 109 sequentially. After that, the rear end of sheet 5-B (P10) is detected by first inlet sensor 105 and second inlet sensor 107 sequentially.

On the other hand, regarding to sheet 3-F (P5), the front end of sheet 3-F (P5) is detected by discharge sensor 120, after passing through image forming unit 20 and fusing unit 30. Next, as sheet 3-F (P5) is transported through discharge unit 50, the rear end of sheet 3-F (P5) is detected by discharge sensor 120. After that, Sheet 3-F (P5) is discharged from printer 10.

Next, after passing through image forming unit 20 and fusing unit 30, the front end of sheet 5-B (P10) is detected by discharge sensor 120. At this time, separator solenoid 208 is turned on so that separator 121 forms the route for leading sheet P to re-feed unit 40.

Also re-feed motor 206 is activated to rotate in a reverse direction so that sheet 5-B (P10) is transported to reverse section 41. Also re-feed clutch 207 is turned off to stop transport roller 127. Next, the front end of sheet 5-B (P10) is detected by re-feed unit inlet sensor 124.

Next, the rear end of sheet 5-B (P10) is detected by discharge sensor 120. At this time, separator solenoid 208 is turned off so that separator 121 forms the route for leading sheet P to discharge unit 50.

On the other hand, regarding to sheet 4-F (P7), as sheet 4-F (P7) is further transported toward the upstream portion of medium transport path 80 by the rotation of transport roller 127, the rear end of sheet 4-F (P7) is detected by re-feed unit front sensor 128. After that, the front end of sheet 4-F (P7) is detected by first inlet sensor 105.

(Time T13 to T14, see FIG. 13 (T14))

Re-feed clutch 207 is turned off to stop transport roller 127. Next, the front end of sheet 4-F (P7) is detected by second inlet sensor 107 and write sensor 109 sequentially. Next, the rear end of sheet 4-F (P7) is detected by first inlet sensor 105, second inlet sensor 107 and write sensor 109 sequentially. Then, the front end of sheet 4-F (P7) is detected by discharge sensor 120, after passing through image forming unit 20 and fusing unit 30. Next, as sheet 4-F (P7) is transported through discharge unit 50, the rear end of sheet 4-F (P7) is detected by discharge sensor 120. After that, sheet 4-F (P7) is discharged from printer 10.

On the other hand, regarding to sheet 5-B (P10), the rear end of sheet 5-B (P10) is detected by re-feed unit inlet sensor 124. Detecting the rear end of sheet 5-B (P10) by re-feed unit inlet sensor 124 triggers drive of re-feed motor 206 in a normal direction, so that sheet 5-B (P10) is transported from reverse section 41 to re-feeding main path 42. Next, re-feed clutch 207 is turned on to rotate transport roller 127. Note that as sheet 5-B (P10) is transported form reverse section 41 to re-feeding main path 42, sheet 5-B (P10) is turned over. After being turned over, the sheet is denoted in the drawings by 5-F(P9) which means the front page of the fifth page (Page 9). Then, the front end of sheet 5-B (P10) is detected by re-feed unit front sensor 128. As sheet 5-F (P9) is further transported toward the upstream portion of main medium transport path 80 by the rotation of transport roller 127, the rear end of sheet 5-F (P9) is detected by re-feed unit front sensor 128. After that, the front end of sheet 5-F (P9) is detected by first inlet sensor 105.

(Time T14 to T15, see FIG. 13 (T15))

Re-feed clutch 207 and re-feed motor 206 are turned off to stop transport roller 127. Next, the front end of sheet 5-F (P9) is detected by second inlet sensor 107 and write sensor 109 sequentially. After that, the rear end of sheet 5-F (P9) is detected by first inlet sensor 105, second inlet sensor 107 and write sensor 109 sequentially. Next, after passing through image forming unit 20 and fusing unit 30, the front end of sheet 5-F (P9) is detected by discharge sensor 120. Next, as sheet 5-F (P9) is transported through discharge unit 50, the rear end of sheet 5-F (P9) is detected by discharge sensor 120. After that, sheet 5-F (P9) is discharged from printer 10.

Next, the temperature control of fusing unit 30 is turned off, ID motor 202 is turned off to stop the rotating mechanism of ID device 113, belt motor 203 is turned off to stop paper sheet transport belt 111, and feed motor 204 is turned off to stop first resist roller 106 and second resist roller 108. After that, fuser motor 201 is turned off to stop fuser roller 117 and discharge roller 122.

As described above, according to the second embodiment, image-fixed and heated sheet P is first held in reverse section 41 having slit 126 near reverse section 41 to release heat and secondly held on flat section 42*a* before re-feeding. With this, similar to the first embodiment, printing can be executed without changing image forming conditions so that there is no influence on the printed image quality. Further, image-fixed sheet P is held in reverse section 41 which has good heat radiation, and this prevents ID device 113 from heating up when the back side is printed. In addition, since sheet P is held on flat section 42*a* after being held in curved reverse section 41, curl of sheet P can be reduced.

According to the above embodiments of the invention, image-fixed and heated sheet P is held until temperature sensor 21 detects temperature equal to or lower than 45° C. or 44° C.; however, the invention is not limited to these. In other words, controller 60 may control so as to stop and hold sheet P for a predetermined period of time. Furthermore, controller 60 may control so as to change the period of time to stop and hold sheet P corresponding to the temperature detected by temperature sensor 21.

In the above embodiment, an electrophotographic printer serving as an image forming apparatus is described; however, the invention can be applied to a copying machine having a double-sided printing mechanism, multifunction printer, and the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus comprising a medium transport path through which a medium is transported;

an image forming unit configured to form a developer image on the medium transported through the medium transport path, wherein the medium transport path has a re-feeding path configured to re-feed medium that had passed through the image forming unit back to the image forming unit;

a fusing unit configured to fix to the medium the developer image formed on the medium;

a temperature detecting unit configured to detect temperature in the image forming apparatus;

a controller operable to temporarily stop the medium in the re-feeding path when the controller determines that the temperature detected by the temperature detecting unit is equal to or higher than the predetermined temperature, an opening provided at the re-feeding path and communicating the outside of the image forming apparatus to the medium transport path.

2. The image forming apparatus according to claim 1 wherein the temperature detecting unit detects temperature of the image forming unit.

3. The image forming apparatus according to claim 1 wherein the image forming unit includes: an image forming device configured to form the developer image; and a transfer device configured to transfer the developer image formed by the image forming device to the medium, wherein the temperature detecting unit detects temperature of the transfer device.

4. The image forming apparatus according to claim 1, wherein the re-feeding path has a reverse section configured to turn-around the medium so as to turn over the medium, the controller operable to temporarily stop the medium in the reverse section, and the opening is provided at the reverse section.

5. The image forming apparatus according to claim 1, wherein the re-feeding path includes: a reverse section configured to turn-around the medium so as to turn over the medium; and a flat section configured to transport the medium straightly, the controller operable to temporarily stop the medium in the flat section.

6. The image forming apparatus according to claim 5, wherein the opening is provided at the reverse section.

7. The image forming apparatus according to claim 1, wherein the re-feeding path includes: a reverse section configured to turn-around the medium so as to turn over the medium; and a flat section configured to straightly transport the medium, the opening is provided at the reverse section, and the controller operable to temporarily stop the medium at the position in the vicinity of the opening in the reverse section and then to temporarily stop the medium in the flat section.

8. The image forming apparatus according to claim 1, wherein the controller operable to temporarily stop the transport of the medium for a predetermined period.

9. The image forming apparatus according to claim 1, wherein the controller operable, when the controller determines that the temperature detected by the temperature detecting unit is equal to or higher than a first predetermined temperature, to stop the transport of the medium, until the controller determines that the temperature detected by the temperature detecting unit is equal to or lower than a second predetermined temperature that is lower than the first predetermined temperature.

* * * * *